United States Patent [19]

Handler et al.

[11] Patent Number: 4,711,183

[45] Date of Patent: Dec. 8, 1987

[54] SHELVING ASSEMBLY WITH DROP-IN SHELF

[75] Inventors: Milton E. Handler, Northbrook; Herbert Baisch, Palatine, both of Ill.

[73] Assignee: Hirsh Company, Skokie, Ill.

[21] Appl. No.: 892,700

[22] Filed: Aug. 1, 1986

[51] Int. Cl.[4] ..... A47B 57/24

[52] U.S. Cl. ..... 108/111; 248/243; 211/187

[58] Field of Search ..... 108/108, 111, 109, 106, 108/156; 312/257 SK; 211/187, 182; 248/243

[56] References Cited

U.S. PATENT DOCUMENTS

| | | | |
|---|---|---|---|
| 754,816 | 3/1904 | Schriefer | 248/243 X |
| 1,852,598 | 4/1932 | Vogt | 248/243 |
| 1,853,018 | 4/1932 | Knape | 248/243 |
| 3,490,393 | 1/1970 | Nelson | 248/243 X |
| 4,101,108 | 7/1978 | Klein | 248/243 |
| 4,201,139 | 5/1980 | Suttles | 249/243 X |

FOREIGN PATENT DOCUMENTS

| | | | |
|---|---|---|---|
| 1196521 | 5/1959 | France | 211/187 |
| 175370 | 2/1951 | Sweden | 211/187 |
| 515259 | 11/1939 | United Kingdom | 248/243 |
| 910835 | 11/1962 | United Kingdom | 211/187 |

*Primary Examiner*—Peter A. Aschenbrenner

*Attorney, Agent, or Firm*—Dressler, Goldsmith, Shore Sutker & Milnamow, Ltd.

[57] ABSTRACT

A shelving assembly is provided with at least one shelf and a shelf support member engaging the shelf along a margin thereof. The shelf support member includes a generally planar vertical wall that is perpendicular to the plane of the shelf. The shelf support member includes a tab having an outwardly projecting portion and a downwardly extending portion parallel to the shelf support member vertical wall. Vertical posts are provided and include at least one vertical wall that is oriented generally parallel to the shelf support member vertical wall. Each post includes a receiving means on the post vertical wall for receiving the downwardly extending portion of one of the tabs with at least the distal end of the downwardly extending portion of the one tab being disposed adjacent the post vertical wall.

4 Claims, 4 Drawing Figures

FIG. 1
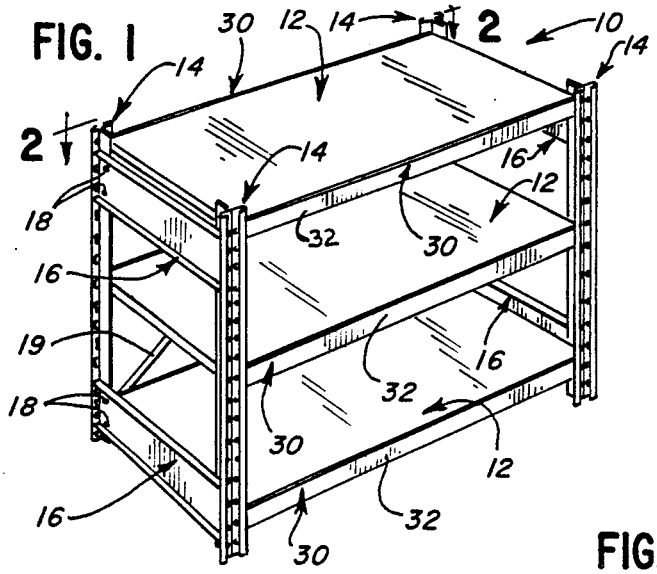
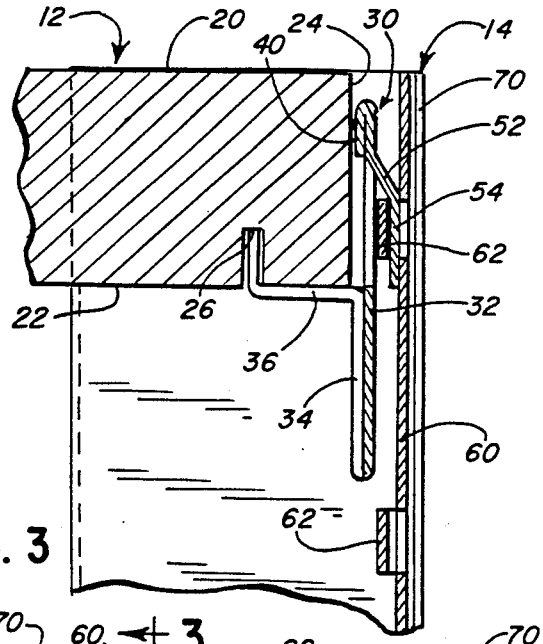
FIG. 3
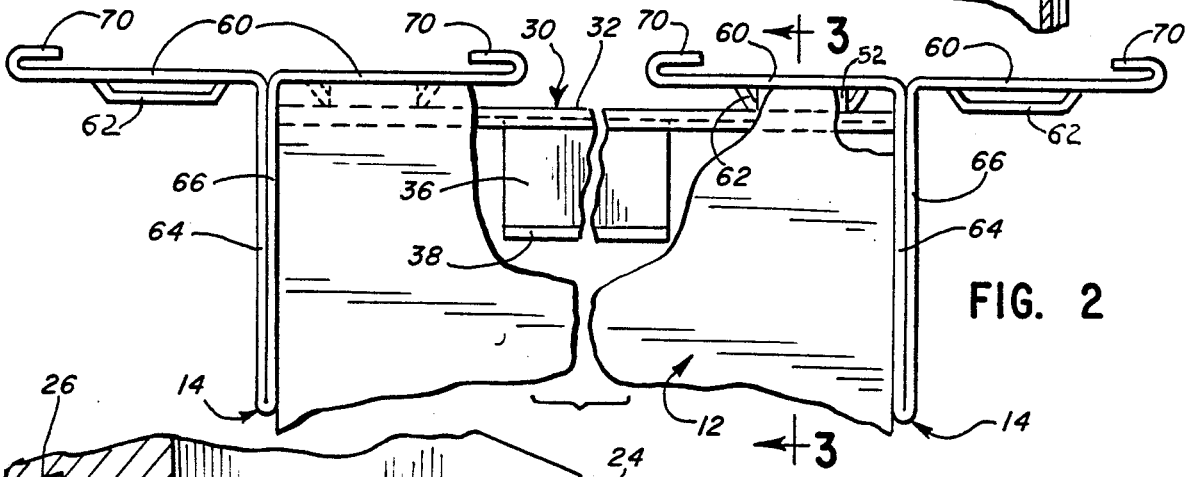
FIG. 2
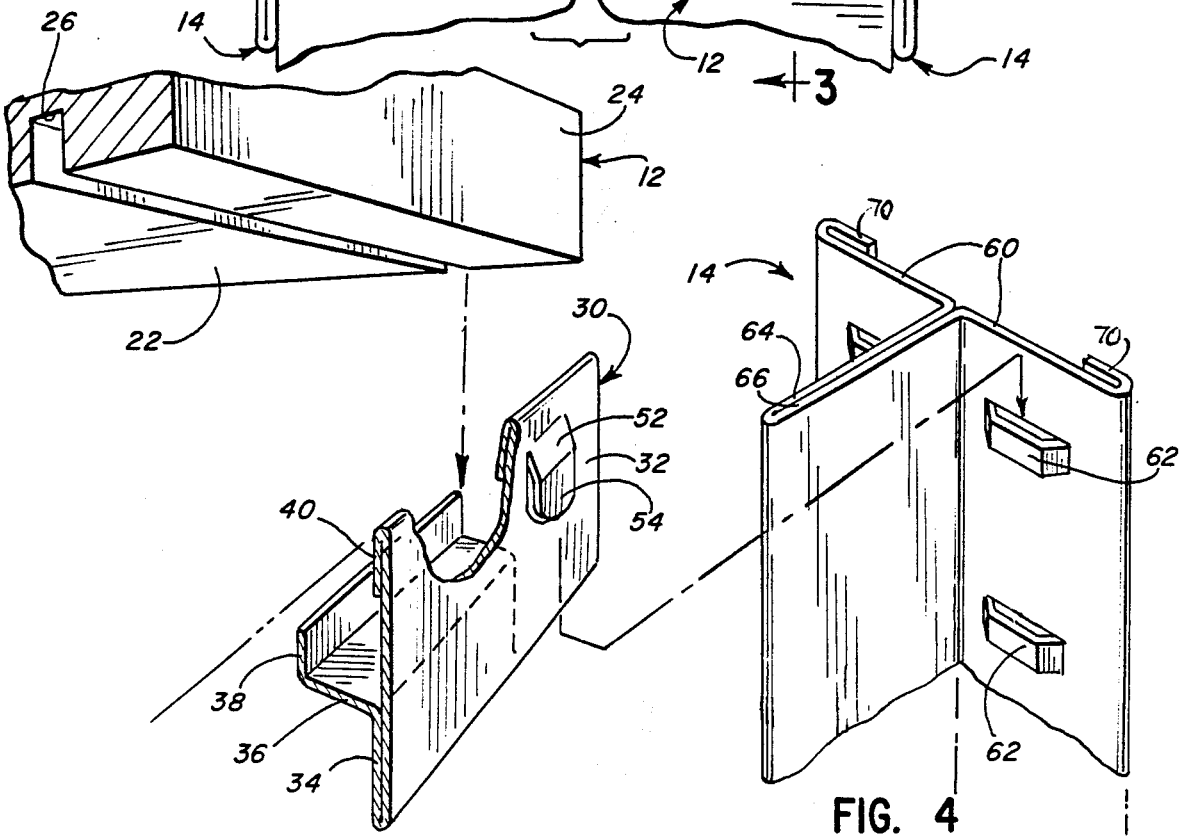
FIG. 4

SHELVING ASSEMBLY WITH DROP-IN SHELF

TECHNICAL FIELD

This invention relates to shelving, and in particular to shelving that may be sold in a knocked-down form for assembly by the purchaser

BACKGROUND OF THE INVENTION AND TECHNICAL PROBLEMS POSED BY THE PRIOR ART

In an effort to reduce the costs of product manufacture, shipping, and storage, a current trend among manufacturers of household furnishings and products is to manufacture the components and provide them as a kit from which the product can be assembled by the purchaser. Factory labor costs are thus reduced since factory assembly is not required. Storage and transportation costs are reduced since the components may be packed in a much smaller package or carton than would be required for the assembled product.

It would be desirable to provide a kit of components for an improved shelving assembly. Further, it would be desirable to provide an assembly design which could accommodate any desired elevation location of the shelf or shelves. Additionally, it would be beneficial if such an assembly could be designed to accommodate convenient attachment to other similar shelving assemblies in an end-to-end configuration.

Such an improved shelving assembly should also desirably accommodate assembly of the components by the purchaser with relative rapidity and ease. It would be advantageous if the assembly could be put together by the purchaser with relatively few separate fasteners, such as screws and the like. Further, it would be especially beneficial if the shelves could be attached to the frame components without any separate fasteners in a way that would permit rapid installation and in a way that would facilitate rapid and easy shelf elevation changes.

Finally, it would be desirable if such an improved shelving assembly could be provided with improved frame support members for increasing the load bearing capacity of the shelving assembly.

SUMMARY OF THE INVENTION

A shelving assembly is provided with at least one shelf and a shelf support member engaging the shelf along a margin thereof. The shelf support member includes a generally planar vertical wall that is perpendicular to the plane of the shelf. The shelf support member includes a tab having an outwardly projecting portion and a downwardly extending portion parallel to the shelf support member vertical wall. Vertical posts are provided and include at least one vertical wall that is oriented generally parallel to the shelf support member vertical wall. Each post includes a receiving means on the post vertical wall for receiving the downwardly extending portion of one of the tabs with at least the distal end of the downwardly extending portion of the one tab being disposed adjacent the post vertical wall. The design provides an improved shelving assembly with increased load bearing capacity that acommodates rapid and easy changing of the elevation of the shelf or shelves.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designated like parts throughout the same, FIG. 1 is a perspective view of the shelving assembly of the present invention;

FIG. 2 is an enlarged, fragmentary, plan view taken along the plane 2—2 in FIG. 1 with a portion of the upper shelf broken away to illustrate underlying detail;

FIG. 3 is a fragmentary, cross-sectional view taken along the plane 3—3 in FIG. 2; and FIG. 4 is an exploded, fragmentary, perspective view of the shelving assembly upper left-hand corner as viewed in FIGS. 1 and 2.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

The shelving assembly is designated in FIG. 1 generally by the reference numeral 10. The shelving assembly includes at least one generally rectangular shelf 12, and in the preferred embodiment illustrated in FIG. 1, three such shelves 12 are included.

Four vertical corner posts 14 are arranged with each one of the posts 14 at a different one of the four corners of each shelf 12. In the preferred embodiment illustrated in FIG. 1, the pair of posts 14 at each end of the assembly 10 may be connected together with frame members 16 by means of suitable fasteners, such as screws 18. Additionally, if desired, cross bracing members 19 (one of which is visible in FIG. 1) may be provided along the back side of the assembly 10. Each cross bracing member 19 is connected to a post 14 at the upper corner at one end of the back of the assembly 10 and is connected to another post 14 at the lower corner at the other end of the back of the assembly 10. Two such members 19 generally define an "X" configuration across the back of the shelving assembly 10. The members 19 may be connected to the vertical corner posts 14 by suitable fasteners, such as screws or the like (not illustrated).

Each shelf 12 has a generally planar top horizontal surface 20 (FIG. 3) and a generally planar bottom horizontal surface 22 (FIG. 3 and FIG. 4). As best illustrated in FIGS. 3 and 4, each shelf 12 defines a side or margin 24, and each shelf 12 defines a groove 26 that is parallel to the shelf margin 24 and that opens to the shelf planar bottom horizontal surface 22.

Each shelf 12 is supported along its opposite side margins 24 by means of shelf support members 30. Each shelf support member 30 is preferably formed from a sheet of metal that defines a generally planar vertical wall 32 which is perpendicular to the plane of the shelf 12. The sheet of metal forming the shelf support member 30 is folded over along a bottom margin to define another wall 34 adjacent and parallel to the shelf support member vertical wall 32. The sheet is folded outwardly 90° along the upper edge of the other wall 34 to define a generally horizontally oriented flange 36 that is perpendicular to the shelf support member walls 32 and 34. The sheet of metal is further folded upwardly 90° along the edge of the flange 36 to define a lip 38 that is generally perpendicular to the flange 36. The lip 38 is received in the groove 26 of the shelf 14. Preferably, the metal sheet is also folded along the upper edge of the vertical wall 32 to form a short wall or bead 40.

As best illustrated in FIGS. 3 and 4, the lip 38 and flange 36 of the shelf support member 30 extend along the shelf support member 30 intermediate the ends of the shelf support member 30 and terminate short of the ends of the shelf support member 30. On the shelf support member vertical wall 32, at each end of the support member 32 and beyond the flange 36, there is provided a tab defined by an outwardly projecting portion 52 and a downwardly projecting portion 54. The downwardly projecting portion 54 extends generally parallel to the shelf support member vertical wall 32 but is spaced outwardly from the exterior surface of the wall 32 by a small amount.

The tab (portions 52 and 54) functions to connect the end of the support member 30 to a vertical corner post 14. To this end, each vertical corner post 14 has at least one vertical wall 60, and each post 14 includes a receiving means 62 (FIGS. 2–4) on the post vertical wall 60 for receiving the downwardly extending portion 54 of the tab such that the distal end of the downwardly extending portion 54 is disposed adjacent the post vertical wall 60.

In the preferred embodiment illustrated, each vertical post 14 is formed from a sheet of metal folded over on itself along a central vertical line to define two parallel wall members 64 and 66. The sheet is further folded outwardly 90° along the vertical edge of each parallel wall member 64, 66 to define two co-planar post flanges which define the vertical walls 60 previously identified. Each post sheet is also folded over about 180° along the edge of each flange wall 60 to form a retainer wall 70 which defines a slot which may receive a strip of trim molding or the like (not illustrated).

Preferably, as illustrated for the preferred embodiment in FIGS. 2–4, the receiving means 62 includes a portion of the vertical post wall 60 that is defined between two spaced-apart parallel slits and that is offset out of the vertical post wall 60 to define a slot for receiving the downwardly extending portion 54 of the tab (FIG. 3). Preferably, as best illustrated in FIGS. 1 and 4, each vertical post 14 includes a plurality of such receiving means 62 spaced apart uniformly along the height of the post 14. This accommodates positioning the shelf support members 30 at any selected elevation as may be desired.

Further, in the preferred form of the invention, each vertical post 14 has a T-shaped configuration (as best seen in FIG. 4) with the two oppositely extending flanges or walls 60 forming the top bar of the "T." With this structure, a shelf support member 30 can be connected to one of the flanges 60 and another shelf support member 30 can be connected to the other of the flanges 60. In this manner, a plurality of shelving assemblies can be assembled in an end-to-end configuration as may be desired.

The novel structures of the shelving assembly components provides a number of other advantages. Specifically, the shelf support members 30 can be quickly and easily mounted to the vertical corner post 14 without the use of screws or other fasteners. The shelves 12 may then be easily mounted to the shelf support members 30, also without the use of screws or other fasteners.

It is to be noted that the novel structure of the shelf support member 30 provides increased strength. This results, in part, from the folding over of the sheet metal to form the two parallel walls 32 and 34.

It is also to be noted that when a shelf 12 is properly mounted on a pair of shelf support members 30, a relatively strong structure results. The combination structure resists inward bending or twisting of the upper edges of the shelf support members 30 when the shelf is subjected to a load because each shelf support member 30 has an upper portion of the vertical wall 32 (such as the bead 40) which will bear against the side margin 24 of the shelf 12.

Further, the engagement between the upturned lip 38 of the shelf support member 30 and the shelf 12 prevents outward bowing of the lower edge of the shelf support member 30 when the entire shelving assembly 10 is subjected to very heavy loads. The unique design thus, in effect, greatly increases the strength of the shelving assembly 10 and reduces the tendency of the shelf support members 30 to bulge or flare outwardly along their lower edges under load.

It will be readily observed from the foregoing detailed description of the invention and from the illustrated embodiment thereof that numerous variations and modifications may be effected without departing from the true spirit and scope of the novel concepts or principles of this invention.

What is claimed is:

1. A shelving assembly comprising:

at least one shelf, said shelf having a generally planar bottom horizontal surface, said shelf defining a groove that is parallel to said shelf margin and that opens to said shelf planar bottom horizontal surface;

a shelf support member engaging said shelf along a margin thereof, shelf support member including a generally planar vertical wall perpendicular to the plane of said shelf, said vertical wall having a top margin and a bottom margin, said shelf support member including a tab between said top and bottom margins of said vertical wall, said tab having an outwardly projecting portion and a downwardly extending portion spaced outwardly of, and parallel to, said shelf support member vertical wall, said shelf support member comprising a sheet of metal that defines said shelf support member vertical wall and that is folded over along said bottom margin to define another wall adjacent and parallel to said shelf support member vertical wall, said sheet being folded outwardly 90 degrees along the upper edge of said other wall to define a generally horizontally oriented flange that is perpendicular to said shelf support member vertical wall, and said sheet being folded upwardly 90 degrees along the edge of said flange to define a lip that is generally perpendicular to said flange for being received in said shelf groove; and vertical posts each including at least one vertical wall that is oriented generally parallel to said shelf support member vertical wall and each post including a receiving means on said post vertical wall for receiving said downwardly extending portion of one of said tabs with at least the distal end of said downwardly extending portion of said one tab being disposed adjacent said post vertical wall.

2. A shelving assembly comprising:

at least one shelf;

a shelf support member engaging said shelf along a margin thereof, said shelf support member including a generally planar vertical wall perpendicular to the plane of said shelf, said vertical wall having a top margin and a bottom margin, said shelf support member including a tab between said top and bottom margins of said vertical wall, said tab having an outwardly projecting portion and a downwardly extending portion spaced outwardly of, and parallel to, said shelf support member vertical wall; and vertical posts each including at least one vertical wall that is oriented generally parallel to said shelf support member vertical wall and each post including a receiving means on said post vertical wall for receiving said downwardly extending portion of one of said tabs with at least the distal end of said downwardly extending portion of said one tab being diaposed adjacent said post vertical wall, each said vertical post being formed from a sheet of metal folded over on itself along a vertical margin to define two parallel wall members, said sheet being folded outwardly 90 degrees along the vertical edge of each said parallel wall member to define two co-planar post flanges, at least one of said receiving means being provided on one of said post flanges, said sheet being folded over about 180 degrees along the edge of each said flange of one of said posts to define a slot for receiving a strip of trim molding or the like.

3. A shelving assembly comprising:

at least one shelf, said shelf having a generally planar bottom horizontal surface, said shelf defining a groove that is parallel to said shelf margin and that opens to said shelf planar bottom horizontal surface;

a shelf support member engaging said shelf along a margin thereof, said shelf support member including a generally planar vertical wall perpendicular to the plane of said shelf, said shelf support member including a tab having an outwardly projecting portion and a downwardly extending portion parallel to said shelf support member vertical wall, said shelf support member comprising a sheet of metal that defines said shelf support member vertical wall and that is folded over along a bottom margin to define another wall adjacent and parallel to said shelf support member vertical wall, said sheet being folded outwardly 90 degrees along the upper edge of said other wall to define a generally horizontally oriented flange that is perpendicular to said shelf support member vertical wall, and said sheet being folded upwardly 90 degrees along the edge of said flange to define a lip that is generally perpendicular to said flange for being received in said shelf groove; and vertical posts each including at least one vertical wall that is oriented generally parallel to said shelf support member vertical wall and each post including a receiving means on said post vertical wall for receiving said downwardly extending portion of one of said tabs with at least the distal end of said downwardly extending portion of said one tab being disposed adjacent said post vertical wall.

4. A shelving assembly comprising:

at least one shelf;

a shelf support member engaging said shelf along a margin thereof, said shelf support member including a generally planar vertical wall perpendicular to the plane of said shelf, said shelf support member including a tab having an outwardly projecting portion and a downwardly extending portion parallel to aaid shelf support member vertical wall; and vertical posts each including at least one vertical wall that is oriented generally parallel to said shelf support member vertical wall and each post including a receiving means on said post vertical wall for receiving said downwardly extending portion of one of said tabs with at least the distal end of said downwardly extending portion of said one tab being disposed adjacent said post vertical wall, each said vertical post being formed from a sheet of metal folded over on itself along a vertical margin to define two parallel wall members, said sheet being folded outwardly 90 degrees along the vertical edge of each said parallel wall member to define two co-planar post flanges, at least one of said receiving means being provided on one of said post flanges, said sheet being folded over about 180 degrees along the edge of each said flange of one of said posts to define a slot for receiving a strip of trim molding or the like.

* * * * *